US005236404A

United States Patent [19]

MacLennan

[11] Patent Number: 5,236,404

[45] Date of Patent: Aug. 17, 1993

[54] SWIMMER TRAINING DEVICE

[76] Inventor: Robert MacLennan, 13716 Puerto St., Ocean Springs, Miss. 39564

[21] Appl. No.: 785,500

[22] Filed: Oct. 31, 1991

[51] Int. Cl.[5] ..... A63B 31/00

[52] U.S. Cl. ..... 482/55; 434/254

[58] Field of Search ..... 482/55, 43; 434/254

[56] References Cited

U.S. PATENT DOCUMENTS 3,988,020 10/1976 Carter ..... 482/55

4,109,905 8/1978 Meier ..... 482/55

5,020,791 6/1991 Phillips ..... 482/55

*Primary Examiner*—Richard J. Apley

*Assistant Examiner*—Lynne A. Reichard

*Attorney, Agent, or Firm*—Alexander Norcross

[57] ABSTRACT

A device for swim training, for a swimmer in a stationary pool, which is attached to a float vest or belt. The belt has two sides; on each of these sides a strap is stitched or attached. These two straps extend, nearly parallel to each other, below the belt and interconnect the belt to a cross bar located behind the feet of a horizontal swimmer wearing the vest. Two lines interconnect the center of the cross bar to two separated points of attachment on the side of a pool. The cross bar separates the straps as they stream below the vest, spacing these straps so that they are clear of the feet of the swimmer. The cross bar in turn forms a point of attachment for connecting the apparatus to the side of the pool.

5 Claims, 1 Drawing Sheet

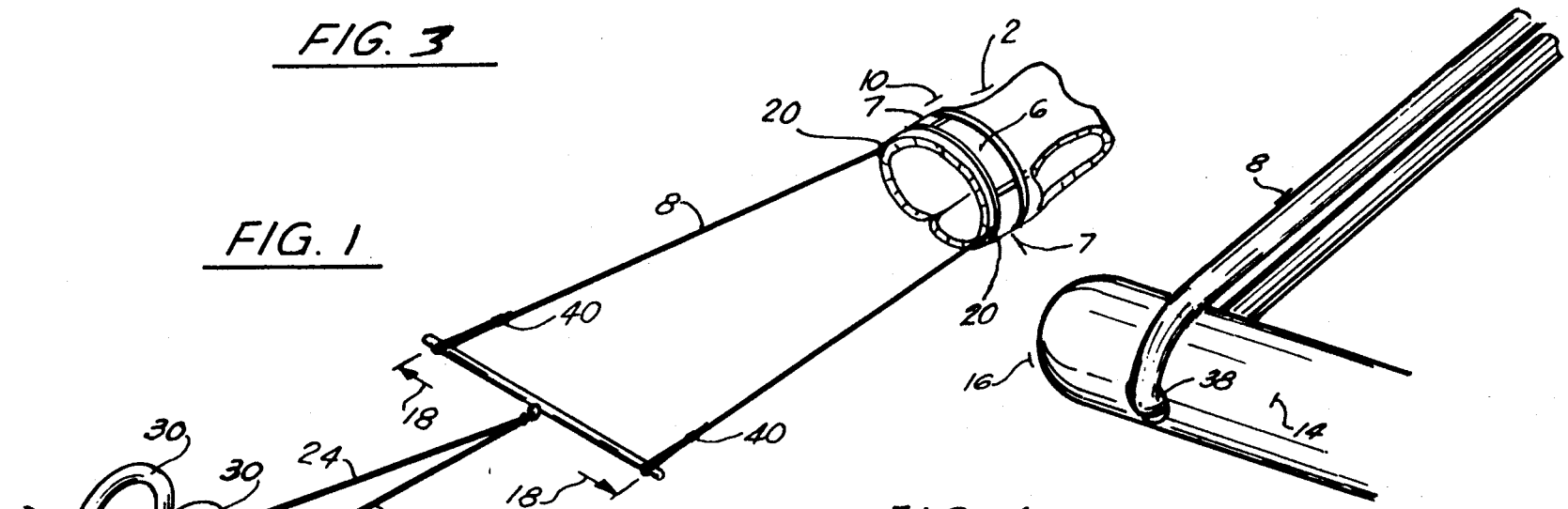
FIG. 1
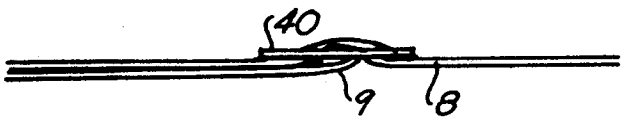
FIG. 3
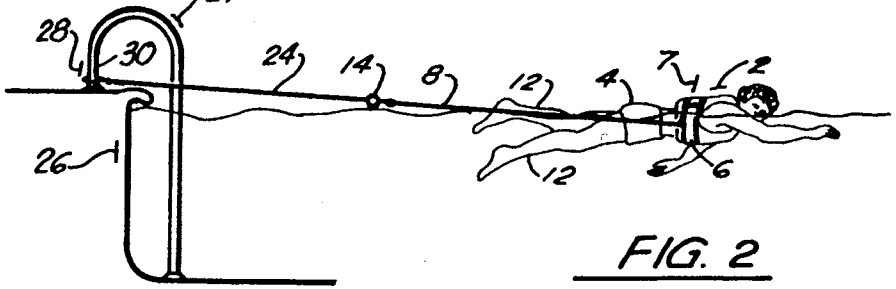
FIG. 2
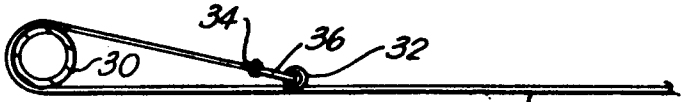
FIG. 5
FIG. 4

SWIMMER TRAINING DEVICE

BACKGROUND OF THE INVENTION

This patent relates to the field of swimmer training devices, for permitting exercise in restricted spaces in swimming pools.

Such devices in the prior art include:

A number of devices consist of cables attached at one end to the waist of the swimmer and at the other end to the wall of a pool, or to a device fixed to the side of the pool.

Soviet Patent 636001, with an English abstract, discloses a swimming device in which the feet are suspended on fixed rods angled at each other. The rods apparently contain instrumentation to determine the power with which the swimmer swims. The feet are engaged by the apparatus and are not free to move.

U.S. Pat. No. 4,551,108 discloses a device attached at two points to a flotation vest and attached at opposite ends of the pool to prevent motion in any direction (FIG. 4). This is an exercise device for weight reduced running; it does not promote swimming.

German Patent 1,190,849 shows a swim training device attached to a belt around the waist. There appears to be no flotation. The swimmer is attached to a belt which passes over a pulley then back to a weight so that the force of the swimmer apparently pulls against the weight to provide resistance. There appear to be two stabilizing lines attached to two points on the wall of the pool.

An extract from a Sports Illustrated article of Sep. 17, 1984 apparently describes a tether attached to a swimmer which appears to rise vertically from the pool, where it is attached to an overhead pole in order to be free of the swimmer's legs.

U.S. Pat. No. 4,948,117 discloses a form of tether which attaches to the ankles of the swimmer. Two such tethers are required but they are apparently moored to a single point.

German Patent 197806 discloses an apparatus for measuring the tractive effort of a swimmer in which a single tether to a swimmer runs over a pulley to a spring scale. The device also has a timer so as to measure the force exerted during a period of time.

German Patent 2821-029 discloses another form of such device in which a single tether passes through a pulley against a spring to vary the resistive force against which the swimmer must exercise.

U.S. Patent 4,247,096 discloses a portable swim trainer device which has a frame fixedly attached to the side wall of a pool, extending to a point above the level of the water. The swimmer is suspended by a spring or bungee cord, a single cable running from the frame to a waist belt worn by the swimmer.

SUMMARY OF THE INVENTION

A device for swim training, for a swimmer in a stationary pool, which is attached to a float vest or belt. The vest has two sides; straps are stitched or attached to each of these sides. These two straps extend, nearly parallel to each other, below the vest and interconnect the vest to a cross bar located behind the feet of a horizontal swimmer wearing the vest. Two lines interconnect the center of the cross bar to two separated points of attachment on the side of a pool.

The cross bar separates the straps as they stream below the vest, spacing these straps so that they are clear of the feet of the swimmer. The cross bar in turn forms a point of attachment for connecting the apparatus to the side of the pool.

In use, the swimmer dons the apparatus and then proceeds to swim in a normal manner against the restraining force of the straps and the vest. The swimmer obtains the advantage of swimming exercise, including a fully aerobic workout, without requiring a large pool or special flowing water apparatus to hold him stationary. The device thus permits full exercise swim training in a relatively small pool.

It is an object of the invention to show a swimmer training apparatus which permits full swimming motion while restraining the swimmer to a single location in a pool.

It is a further object of the invention to show a swimmer training apparatus which permits full swimming motion by a swimmer in a small or restricted space.

It is a further object of the invention to show a swimmer training apparatus which permits full swimming motion by a swimmer in a restrained space without requiring installation of supports above the swimming pool.

It is a further object of the invention to show a swimmer training apparatus which permits full swimming motion by a swimmer in a restricted space, the apparatus being easily disassembled and carried by the swimmer.

It is a further object of the invention to show a swimmer training apparatus which permits full swimming motion by a swimmer in a restricted space with minimum obstruction to activities of others in the same pool.

These and other objects of the invention may be seen from the detailed description which follows.

BRIEF DESCRIPTION OF THE DRAWINGS

FIG. 1 is a view of the invention attached to the side of a pool.

FIG. 2 is a side view of a swimmer exercising, restrained by the invention.

FIG. 3 is a detail view of an adjustment means for the strap of the invention.

FIG. 4 is a view of an end of the separator bar of the invention.

FIG. 5 is a detail view of the connection of a line from the invention to a pool side fitting.

DETAILED DESCRIPTION OF THE PREFERRED EMBODIMENT

This invention relates to swim training devices and exercise devices for persons who wish to engage in swimming, yet are restricted in terms of the size of the pool in which they swim or in terms of their ability to move freely about in the water while swimming.

It is well known that swimming is an exercise that strengthens and tones all the major muscles of the body and has beneficial cardiovascular effects. It is considered by some to be more beneficial as an aerobic exercise than running or jogging because swimming involves no impact to the body and thus the swimmer avoids, even with strenuous exercise, any significant risk of joint damage or muscular strains.

However, to be effective as an aerobic exercise, the swimmer must in fact engage in full stroke swimming, utilizing coordinated movements of both the arms and the legs, moving through the water.

With the ever increasing popularity of aquatic sports, it has become increasingly difficult for a person desiring to swim to find an open body of water of sufficient size that one can actually swim for a distance or do laps in the water. Even in swimming pools that may be designed with lanes to allow such swimming, the number of swimmers or persons in the pool often precludes a swimmer from having a free and open area in which to swim over a distance or for repeated laps. More often, the space requirements expense of operating a large swimming pool means that only small amounts of water or small pools are available for a person who wishes to exercise in the water. This is especially a factor for travelers, who must contend with small hotel type pools designed more for relaxed floating than for serious swimming.

In the background of the invention we have shown various artifacts or restraints that have been proposed to restrain a person exercising in the water so that they can fully exercise without moving through the water, and thus supposedly can exercise in a relatively small body of water or in a restricted space. A disadvantage of substantially all of these exercise devices is that they either interfere with free swimming motion or, alternatively, they are themselves so bulky or expensive as to preclude ready availability and use.

The prime example of an expensive solution is the swimming pool which is provided with pumped, free flowing water so as to provide a current past the swimmer to hold him in a fixed position. This is a specialized pool, quite evidently non-portable, and requiring even more cost and expense than a standard swimming pool.

Those devices which attempt to physically restrain the swimmer but allow free motion of the hands and arms now involve elaborate physical structures which have to be mounted over the swimmer or over the swimming pool, and which are fixed into position. Inasmuch as such structures must resist the weight and motion of the swimmer, they tend to be bulky, expensive and interfere with other uses of the pool.

The invention, therefore, as disclosed in the figures, is of a swimmer restraining device which is portable, easily put on and removed, that will successfully restrain a swimmer within a fixed space within a swimming pool, yet permit the swimmer full and complete swim motions including coordinated motions of both the arms and the legs.

Referring to FIG. 1, I show, as part of the invention, a body restraining fitting 2 which is usually in the form either of a swim vest or of a waist belt worn about the swimmer 4. It may optionally be desirable to make this body restraining fitting 2 as a vest 2 or belt with some degree of floatation such as a standard non-inflatable life jacket, if this will aid the swimmer 4. In the embiodiment shown in the figures the body restraining fitting 2 is a foam flotation life jacket with a reinforced waist belt.

However as a bulky jacket would interfere with the free motions of the swimmer, a full flotation jacket is not probably appropriate; a foam jacket 2 or belt having some flotation but otherwise not interfering with the motions of the swimmer 4 may be a preferred form of body restraining fitting 2 if floatation is desired.

A belt 6 or reinforced circular web around the waist of the swim jacket may be provided. To the two sides of the jacket 2 are sttached two bridle straps 8 so as to provide for an even symmetrical restraint on both the left side 10 and the right side 12 of the jacket 2.

FIG. 2 shows a swimmer 4, wearing the invention, doing a horizontal stroke such as is commonly called a crawl.

As can be seen, the bridle straps 8 in this position restrain the swimmer 4 against a forward motion and thus extend horizontally from the waist 7 of the swimmer 4, from their point of attachment to the jacket 2, streaming back, substantially parallel to the swimmer's legs 12. Two bridle straps 8 are therefore provided, and are spaced a distance apart by a cross bar or separator bar 14. The separator bar 14 has two ends 16, and a bridle strap 8 is attached to each of the two ends 16. The distance 18 between these ends of the bridle strap 8, where they are attached to the separator bar 14, is greater than the distance between the ends 20 of the bridle straps 8 that are attached to the jacket 2, so as to cause the bridle straps 8 to be spaced a wider distance apart in the vicinity of the swimmer's legs 12 and feet.

The separator bar 14 is in turn attached, from a mid point 22 on the bar, preferably by two lines or cables 24, to any available object on the side of the pool 26. Most typically it will be found that ladders 27 or similar structures are spaced along the side of a pool 26 and such constructions provide a convenient point of attachment 28 of the restraining lines 24.

It is desired that the restraining lines 24 be attached to the separator bar 14 at the center 24 of the bar, balancing the bar 14 against the pull on each end 16 imparted by the two bridle straps 8. Using two lines 24 permits the separator bar 14 to be attached to two separated points of attachment 28 on the side of the pool 26, and reduces any tendency of the apparatus to sway from side to side under the pull of swimming. These points of attachment 28 need not be widely separated, and in particular, they should not be on opposite sides of the pool 26. A preferred attachment is to the two side rails 30 of a pool side ladder 27. There will thus be little interference with other's use of the pool even with two lines attaching the apparatus to the pool side.

FIG. 5 shows a preferred method of such connection, in which small rings 32 are woven or spliced into the restraining lines 24 near the free ends 34 of the line 24. A snap hook 36 or clip is fastened to the free end 34 of each line 24. The line 24 can then be easily fastened to any suitable object at pool side, such as a boarding ladder 27, by passing the line free end 24 around the object and fastening the snap hood 36 to the ring 32, enclosing the pool side object in a closed loop of the restraining line 24.

Each bridle strap 8 should be the same length as the other bridle strap so that the separator bar 14 is maintained in a substantially transverse direction to the pull of the swimmer 4 while swimming. It is preferable that the bridle straps 8 be adjustable in length to insure that this configuration can be maintained, and this may be readily accomplished either by tying the straps 8 to the ends 16 of the separator bar 14 or by providing holes 38 in each end of the separator bar 14 through which the bridle strap 8 may be passed and looped back upon itself, its length adjusted by any of a number of sliding clamps 40 to permit the length of each bridle strap 8 to be readily adjusted.

Such clamps 40 are well known in the art of ropes and fastenings and any suitable clamp may be used. For example, in FIG. 3 I show a strap adjustment in which the strap 8 and the end 9 of the strap 8 are passed through a buckle 40 having two holes so that tension on the strap 8 pulls the strap 8 and strap end 9 tightly together; this device is widely known and seen in luggage and on camping equipment for strap length adjustment. Other equally effective methods of such adjustment are known and will be apparent to those skilled in the art.

It is also apparent that the bridle strap 8 may be made from a rope equally as well as from webbing. The word strap is not intended to restrict the material from which the bridle strap 8 is made or to designate its shape, but merely to distinguish between the identification of the bridle straps 8 and the restraining lines 24, both of which may be made of the same materials. The strap should be of a material, such as nylon or the like, which is resistant to water but which has sufficient strength to resist the forward motion and pull of an active swimmer.

The restraining lines 24 or cables may likewise be made of an identical strapping material or of a rope. By affixing one end of the restraining lines 24 to the exact center 22 of the separator bar 14, a symmetrical pull is imposed upon the separator bar 14, retaining it in a transverse position against the motion of the swimmer 4.

In use, a swimmer 4, desiring the beneficial exercise of swimming but restricted because of the size of the pool or the crowdedness of the pool from actually having enough free space to swim, would still be able to enjoy the exercise by donning the belt or jacket 2 of the invention and entering the water, and fastening the restraining cables 24 to a convenient point 28 on the side of the pool 26, such as to the vertical supports of a boarding or pool entrance ladder 27.

The swimmer 4 then can actively swim using a crawl or any of a number of strokes which normally impart forward motion. The force of the swimmer's forward motion is exerted against the jacket or belt 2 and coupled through the bridle straps 8 to the separator bar 14. The separator bar 14, being under tension, pulls on the bridle straps 8, holding them straight; at the same time the separator bar 14 separates the bridle straps 8 so that the feed and legs 12 of the swimmer are completely free of the bridle straps 8 and are not interfered with during the swimming motion. The balance provided by having two bridal straps 8 of equal length maintains the separator bar 14 substantially transverse to the direction of the swimmer 4. All the force of the swimmer is concentrated in and restrained by the restraining cable 24 which runs from the separator bar 14 to the point of attachment 28 at the side of the pool 26.

The restraining lines 24 preferably should be attached to the separator bar 14 by a swivel at the midpoint of the separator bar 14. The separator bar 14 can then rotate about the restraining lines 24 without twisting them, and this permits the swimmer 4 turn in the water, switching between swimming on his back and face down.

No structure hangs over the pool and no permanent structure needs to be affixed to the side of the pool.

As a result, the invention may readily be carried by a traveller who wishes to swim at pools he may visit, and substantially no setup and take down time is required. The apparatus will not interfere with other person's enjoyment of the pool and thus is particularly suited for use in a crowded or public swimming pool by one who desires swimming exercise without interfering with the play activities of others.

As it can be seen from the description there are numerous small variations especially in the type of material and/or strapping used for the bridle and restrainer line and in the exact method of affixing the bridle lines to the vest or belt and to the separator bar so as to permit easy adjustment of the length of the bridle to fit varying sized swimmers.

Thus the invention extends beyond the specific embodiment shown in the figures to that wider range of equivalents as are inherent in the art.

I claim:

1. An apparatus for restraining a swimmer's position in a pool, while swimming, comprising:

means for attachment of the apparatus around the waist of a swimmer, defining two sides thereof;

a first strap, extending from a first end affixed to a first side of said means for attachment, extending to and affixed at a second end to a first end of a separator bar;

a second strap, extending from a first end affixed to a second side of said means for attachment, extending to and affixed to a second end to a second end of said separator bar;

said separator bar holding said second ends a spaced distance apart;

means for pool side support, adapted for removable attachment to a side of a pool;

said means for pool side support further comprising:

at least one line extending from a point in the middle of said separator bar to the point of connection on the side of the pool;

said separator bar being intermediate said point of connection and said means for attachment of the apparatus around the waist.

2. The apparatus of claim 1, said line further comprising:

a ring spliced into said line at a point intermediate the separator bar and the free end of said line;

a snap hook attached to said free end, said line being affixed to said point of connection by looping said line about the point of connection and fastening said snap hook to said ring.

3. An apparatus for restraining a swimmer's position in a pool, while swimming, comprising:

means for attachment of the apparatus around the waist of a swimmer, defining two sides thereof;

a first strap, extending from a first end affixed to a first side of said means for attachment, extending to and affixed at a second end to a first end of a separator bar;

a second strap, extending from a first end affixed to a second side of the waist belt, extending to and affixed at a second end to a second end of said separator bar;

means, for removably attaching said separator bar to a side of a pool;

said means for removably attaching said separator bar further comprising:

a first and a second line, each extending from a point in the middle of said separator bar, each extending to differing pints of connection on the side of the pool, such that side to side sway of the apparatus is limited.

4. The apparatus of claim 3, further comprising:

said lines being affixed to said point in the middle of said separator bar by a swivel, such that the swimmer may turn in the water while swimming without tangling said lines.

5. An apparatus for restraining a swimmer's position in a pool, while swimming, comprising:

means for attachment of the apparatus around the waist of a swimmer, defining two sides thereof;

a first strap, extending from a first end affixed to a first side of said means for attachment, extending to and affixed at a second end to a first end of a separator bar;

a second strap, extending from a first end affixed to a second side of said means for attachment, extending to and affixed at a second end to a second end of said separator bar;

said separator bar holding said straps free of the swimmer's feet and legs while swimming;

a first and a second line, each extending from a point in the middle of said separator bar, each extending to differing points of connection on the side of the pool, such that side to side sway of the apparatus is limited.

* * * * *